US010363651B2

(12) United States Patent
Moore

(10) Patent No.: US 10,363,651 B2
(45) Date of Patent: Jul. 30, 2019

(54) HAMMER ASSEMBLY

(71) Applicant: Caterpillar Inc., Peoria, IL (US)

(72) Inventor: Cody Moore, Waco, TX (US)

(73) Assignee: Caterpillar Inc., Deerfield, IL (US)

( * ) Notice: Subject to any disclaimer, the term of this patent is extended or adjusted under 35 U.S.C. 154(b) by 600 days.

(21) Appl. No.: 14/867,130

(22) Filed: Sep. 28, 2015

(65) Prior Publication Data

US 2017/0087703 A1 Mar. 30, 2017

(51) Int. Cl.

| | |
|---|---|
| ***B25D 9/14*** | (2006.01) |
| ***B25D 9/04*** | (2006.01) |
| ***B25D 17/00*** | (2006.01) |
| ***E02F 3/96*** | (2006.01) |
| *E02F 9/22* | (2006.01) |

(52) U.S. Cl.

CPC ..... *B25D 9/145* (2013.01); *B25D 9/04* (2013.01); *B25D 17/00* (2013.01); *E02F 3/966* (2013.01); *B25D 2250/121* (2013.01); *B25D 2250/365* (2013.01); *E02F 9/22* (2013.01)

(58) Field of Classification Search

CPC ..... E21B 21/10; E21B 21/103; E21B 33/12; B25D 2209/002; B25D 9/145; B25D 9/04; B25D 17/00; B25D 2250/365; B25D 2250/121; E02F 3/966; E02F 9/22

USPC ..... 173/47, 184, 200, 218

See application file for complete search history.

(56) References Cited

U.S. PATENT DOCUMENTS

| | | | | | |
|---|---|---|---|---|---|
| 2,392,560 | A * | 1/1946 | Vitoux | B44B 3/005 | 173/133 |
| 2,595,317 | A * | 5/1952 | White, Jr. | B05B 9/0833 | 222/80 |
| 3,251,380 | A * | 5/1966 | Mercier | F15B 1/08 | 137/223 |
| 3,302,664 | A * | 2/1967 | Plamann | F24C 5/16 | 138/89 |
| 3,370,770 | A * | 2/1968 | Henning | B25C 1/10 | 102/531 |
| 3,423,939 | A * | 1/1969 | Ferrell | B60T 11/22 | 137/852 |
| 3,584,769 | A * | 6/1971 | Pinke | B65D 51/1683 | 222/340 |
| 3,593,746 | A * | 7/1971 | Allewitz | F15B 1/165 | 138/30 |
| 3,613,512 | A * | 10/1971 | Taft | F01B 17/00 | 92/13.8 |
| 3,724,560 | A * | 4/1973 | Tibbott | B25B 23/145 | 173/178 |
| 3,776,457 | A * | 12/1973 | Cardi | F01P 7/16 | 137/74 |

(Continued)

FOREIGN PATENT DOCUMENTS

| | | |
|---|---|---|
| GB | 1128280 | 9/1968 |
| JP | 2013103309 | 5/2013 |

*Primary Examiner* — Robert F Long

(74) *Attorney, Agent, or Firm* — Miller, Matthias & Hull

(57) ABSTRACT

A hammer including a housing and a piston arranged for reciprocating movement within the housing is disclosed. The hammer further includes a head assembled on the housing and defining a chamber for holding a pressurized gas and a wall configured to abut the housing and defining a gas discharge passage extending between the chamber and the housing. A plug is positioned in the gas discharge passage and configured to move or deform under pressure of the pressurized gas in the chamber.

14 Claims, 5 Drawing Sheets

(56) References Cited

U.S. PATENT DOCUMENTS 3,887,018 A * 6/1975 Jayne ..... B25D 9/06 173/120
3,892,279 A 7/1975 Amtsberg
3,973,858 A * 8/1976 Poisson ..... B23Q 3/16 408/10
4,072,198 A 2/1978 Amtsberg
4,079,691 A * 3/1978 Curado ..... B60C 23/04 116/34 R
4,195,658 A * 4/1980 Dierksmeier ..... F16K 17/30 137/462
4,231,489 A * 11/1980 Malone ..... B65D 83/38 215/307
4,290,489 A * 9/1981 Leavell ..... B25D 9/14 173/133
4,370,916 A * 2/1983 Mitin ..... B25D 9/145 91/173
4,421,067 A * 12/1983 Krowech ..... F28G 3/16 122/390
4,503,678 A * 3/1985 Wimbush ..... B60T 11/26 137/854
4,550,481 A * 11/1985 Preston ..... B25B 13/48 29/213.1
4,552,227 A * 11/1985 Wohlwend ..... B25D 9/265 173/15
4,552,283 A * 11/1985 Poldner ..... B01D 35/14 220/203.04
4,601,349 A * 7/1986 Arentsen ..... E02D 7/10 173/200
4,676,323 A * 6/1987 Henriksson ..... B25D 9/12 138/30
4,802,651 A * 2/1989 Lew ..... F16K 41/106 251/161
4,817,737 A * 4/1989 Hamada ..... B25D 9/12 173/115
5,290,972 A * 3/1994 Someya ..... G06F 3/03545 178/19.04
5,295,165 A * 3/1994 Hankinson ..... G21C 13/067 376/203
5,378,064 A * 1/1995 Satoh ..... G21C 7/08 376/230
5,515,838 A * 5/1996 Anderson ..... F41B 11/721 124/73
5,549,252 A * 8/1996 Walter ..... B02C 1/005 241/264
5,893,419 A * 4/1999 Hodges ..... B25D 9/12 173/13
5,896,933 A * 4/1999 White ..... B25C 1/043 227/130
5,944,120 A * 8/1999 Barden ..... B25D 9/145 173/135
6,085,635 A * 7/2000 Trevisan ..... F15B 20/00 92/121
6,367,517 B1 * 4/2002 Hoermann ..... C06B 21/00 141/67
6,506,007 B1 * 1/2003 Kishimoto ..... B23P 19/067 411/14.5
6,557,577 B1 * 5/2003 Corte, Jr. ..... F16K 31/50 137/15.18
6,736,162 B2 5/2004 Schimnowski et al.
7,458,558 B1 * 12/2008 Toth ..... F16K 24/00 251/145
7,516,801 B2 * 4/2009 Meixner ..... B25D 9/26 173/104
7,762,282 B2 * 7/2010 Coscarella ..... F16L 55/115 138/89
8,104,647 B2 * 1/2012 Bober ..... B05B 9/0822 222/153.09
8,267,123 B2 9/2012 LeBlanc et al.
8,640,939 B2 * 2/2014 Ferrier ..... B25C 1/14 227/10
8,733,737 B2 3/2014 Lewandowski et al.
9,308,635 B2 * 4/2016 Moore ..... B25D 9/145
2003/0005962 A1 * 1/2003 Lin ..... G05D 16/0686 137/505.46
2005/0092392 A1 * 5/2005 Abe ..... B67D 7/0294 141/374
2006/0124661 A1 * 6/2006 Siimes ..... F16K 1/303 222/3
2009/0008415 A1 * 1/2009 Ohshima ..... B05B 11/3011 222/383.1
2010/0230461 A1 * 9/2010 Tanaka ..... B25C 1/08 227/9
2011/0114692 A1 * 5/2011 Liang ..... B25C 1/04 227/2
2011/0139475 A1 * 6/2011 Braun ..... B25D 9/10 173/112
2011/0290850 A1 * 12/2011 Wu ..... B25C 1/04 227/130
2012/0255183 A1 10/2012 Myrhum, Jr.
2013/0037766 A1 * 2/2013 Liao ..... B25B 11/007 254/133 R
2013/0082083 A1 * 4/2013 Largo ..... B25C 1/041 227/8
2013/0211248 A1 * 8/2013 Cowan ..... A61M 5/1452 600/432
2013/0255985 A1 * 10/2013 Zakuskin ..... B25D 9/10 173/209
2013/0270319 A1 * 10/2013 Gauger ..... B25C 1/08 227/2
2014/0102740 A1 * 4/2014 Jagdale ..... E02F 3/966 173/114
2014/0124686 A1 * 5/2014 Hallundbæk ..... E21B 33/064 251/1.3
2014/0209340 A1 * 7/2014 Moore ..... B25D 9/145 173/112

* cited by examiner

HAMMER ASSEMBLY

TECHNICAL FIELD

Present disclosure relates to the field of hammers. In particular, the present disclosure relates to a hammer assembly.

BACKGROUND

Hydraulic hammers are used on work sites to break up large hard objects before such objects can be moved away. Hydraulic hammers may be mounted to back hoes or excavators, or may be hand-held. Typically, the hammer assembly is powered by either a hydraulic or pneumatic pressure source. During a work or power stroke, high fluid pressure is applied to a first shoulder of a piston, thereby driving the piston in a forward direction. The piston then strikes a work tool, which is driven in the forward direction thereby causing a work tip of the tool to strike the rock, concrete, asphalt or other hard object to be broken up. During a return stroke, fluid pressure is applied to a second shoulder of the piston in order to return the piston to its original position.

A hammer assembly may have an accumulator for augmenting the strike power of the piston on the work tool. The accumulators provide for a biasing force to the piston towards the work tool. Generally, such accumulators have a pressurized gas, for example nitrogen, that is contained in a chamber of the hammer. On disassembly of the hammer for service or maintenance, the gas is released from the chamber. For releasing the gas inside the chamber special tools may be required. Generally, a gas valve is provided on the hammer that may be opened using a tool to release the gas inside the chamber before the hammer is disassembled. The present disclosure addresses one or more issues with gas pressure during disassembly of hammers.

SUMMARY OF THE INVENTION

A hammer including a housing and a piston arranged for reciprocating movement within the housing is disclosed. The hammer further includes a head assembled on the housing and defining a chamber for holding a pressurized gas. The head further includes a wall configured to abut the housing and defining a gas discharge passage extending between the chamber and the housing. A plug is positioned in the gas discharge passage and configured to move or deform under pressure of the pressurized gas in the chamber on separation of the head from the housing.

A hammer including a first member and a second member is disclosed. The first member and the second member are configured for attachment to each other and define a chamber for holding a pressurized gas. Further, a gas discharge passage is defined in the first member and extending between the chamber and an outside surface of the first member. A plug inserted in the gas discharge passage, the plug is retained in the gas discharge passage against the pressure of the gas in the chamber by the second member such that the plug permits escape of gas through the gas discharge passage on separation of the first member from the second member.

A method of assembling a hammer is disclosed. The hammer includes a housing for holding a piston and a head for mounting on the housing and the head defines a chamber for holding a pressurized gas. The head further includes a wall configured to abut the housing and defining a gas discharge passage extending between the chamber and the housing. The method for assembling such hammer includes placing a plug in the gas discharge passage to prevent escape of gas from the chamber, the plug configured to move or deform under pressure of the gas in the chamber on separation of the head from the housing. The method further includes mounting the head on the housing such that the ejection of the plug from the head is prevented by the housing and pressurizing the chamber with a gas.

DETAILED DESCRIPTION

Figure 1:
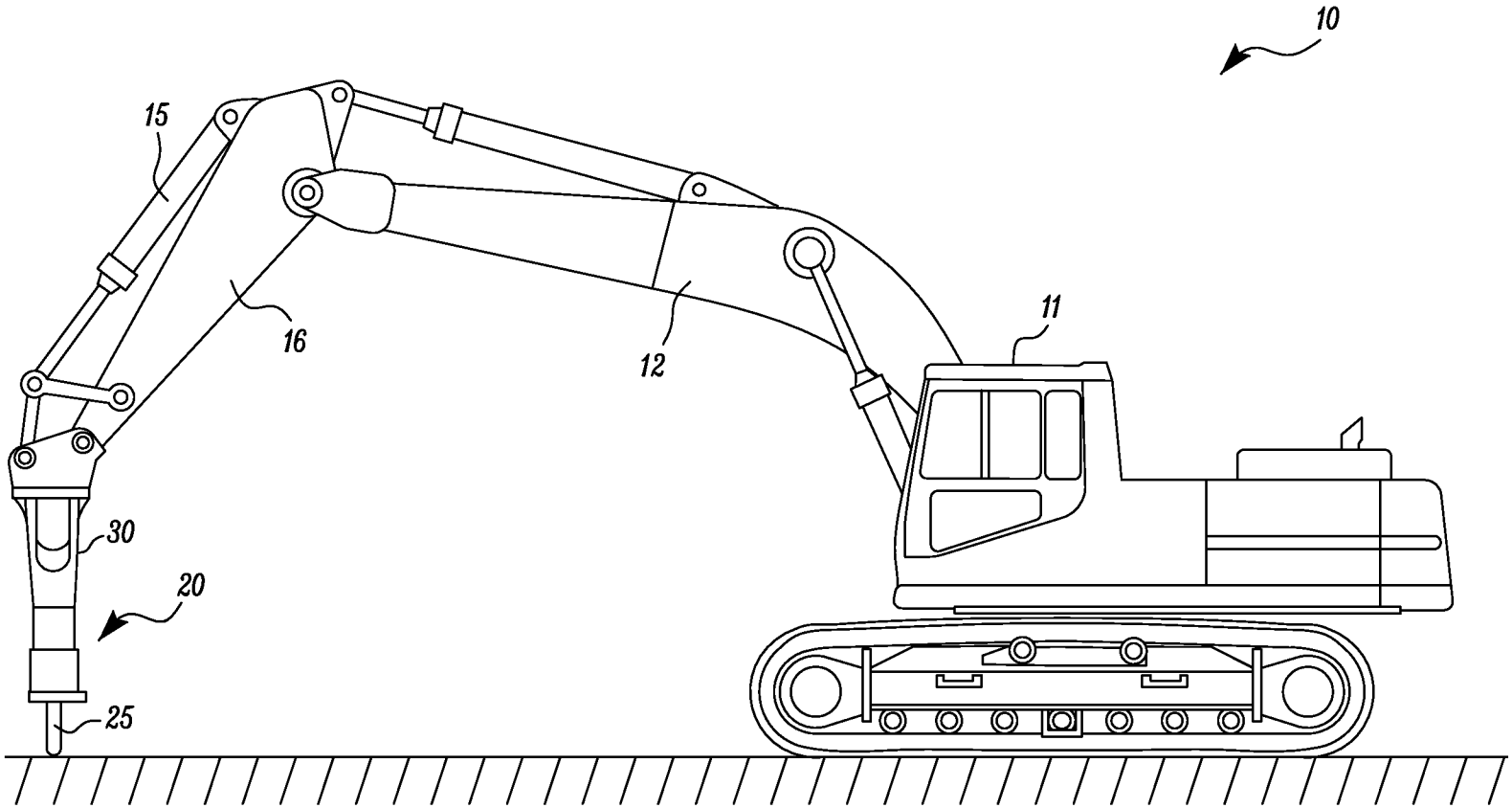
FIG. 1 illustrates a schematic diagram of a work machine in accordance with an embodiment.

FIG. 1 illustrates an exemplary work machine 10 that may incorporate a hammer 20. Work machine 10 may be configured to perform work associated with a particular industry such as, for example, mining or construction. For example, work machine 10 may be a backhoe loader, an excavator (shown in FIG. 1), a skid steer loader, or any other machine. Hammer 20 may be connected to work machine 10 through a boom 12 and an arm 16. It is contemplated that other linkage arrangements known in the art to connect the hammer 20 to the work machine 10 may alternatively be utilized.

In the disclosed embodiment, one or more hydraulic cylinders 15 may raise, lower, and/or swing boom 12 and stick 16 to correspondingly raise, lower, and/or swing hammer 20. The hydraulic cylinders 15 may be connected to a hydraulic supply system (not shown) within work machine 10. Specifically, work machine 10 may include a pump (not shown) connected to hydraulic cylinders 15 and to hammer 20 through one or more hydraulic supply lines (not shown). The hydraulic supply system may introduce pressurized fluid, for example oil, from the pump and into the hydraulic cylinders 15. Operator controls for movement of hydraulic cylinders 15 and/or hammer 20 may be located within a cabin 11 of work machine 10.

As shown in FIG. 1, hammer 20 may include an outer shell 30 and an actuator assembly 32 (shown in FIG. 2) located within outer shell 30. A work tool 25 may be operatively connected to an end of actuator assembly 32 opposite stick 16. It is contemplated that work tool 25 may include any known tool capable of use with hammer 20. In one embodiment, work tool 25 includes a chisel bit.

Figure 2:
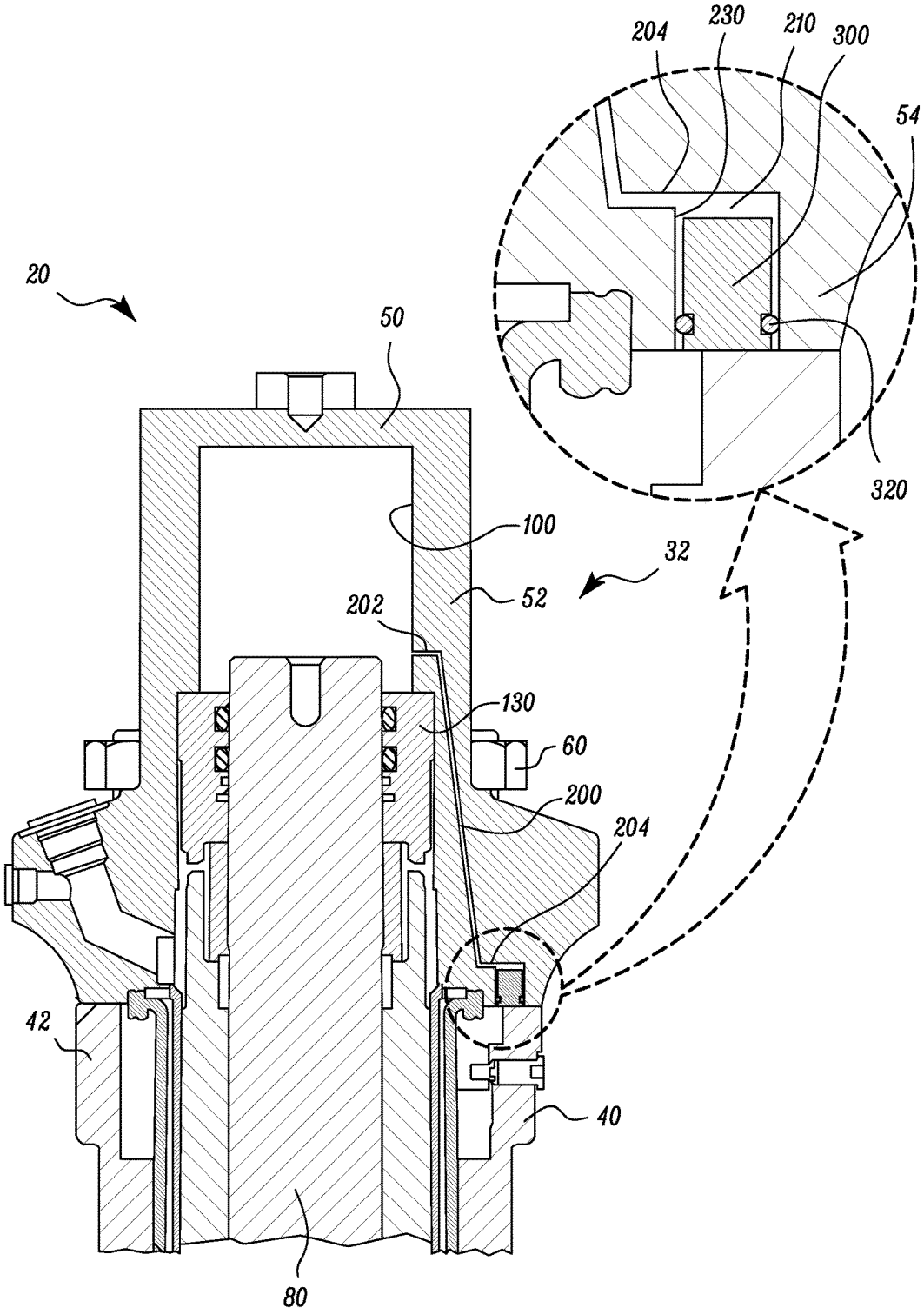
FIG. 2 illustrates a cutaway view illustration of the hammer assembly in accordance with an embodiment.
Figure 3:
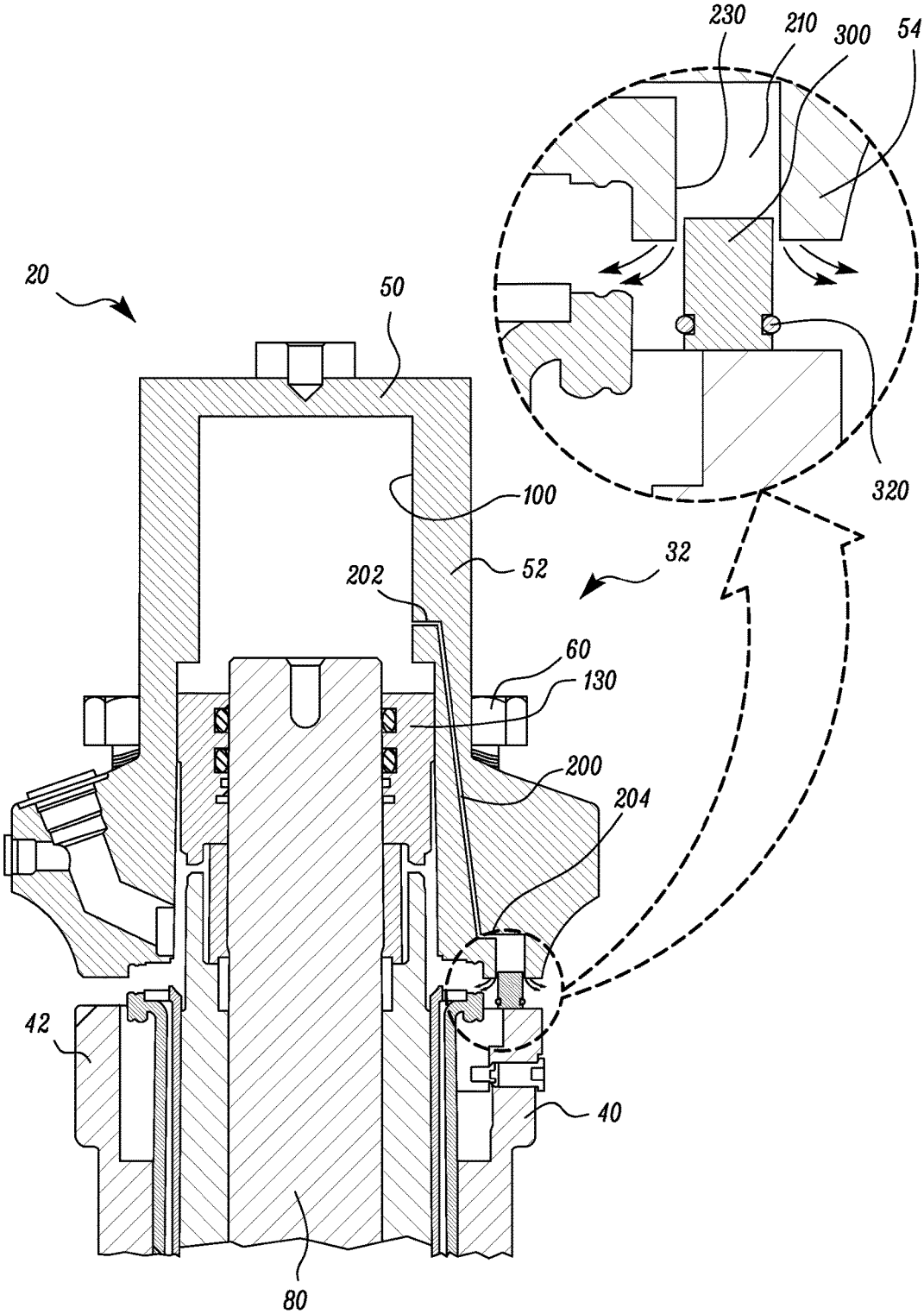
FIG. 3 illustrates a cutaway view illustration of the hammer assembly in accordance with an embodiment.

As shown in FIG. 2, actuator assembly 32 may include, among other things, a housing 40 and a head 50. Housing 40 may be a hollow cylindrical body having one or more housing flanges 42 or steps along its axial length. Head 50 may cap off one end of housing 40. Specifically, one or more head flanges 54 on head 50 may couple with one or more housing flanges 42 on housing 40 to provide a sealing engagement. One or more fasteners 60 may rigidly attach head 50 to housing 40. In some embodiments, fasteners 60 may include, for example, screws, nuts, bolts, or any other means capable of securing the two components. Housing 40 and head 50 may each include holes (not shown) to receive fasteners 60.

As shown in FIG. 2, actuator assembly 32 may be an assembly including, among other components, a piston 80 and a seal carrier 130. Head 50 may be configured to close off an end of the housing 40 when connected to housing 40. Furthermore, piston 80 may be configured to slide within both housing 40 and head 50 during operation of the hammer 20.

FIG. 2 further illustrates chamber 100 disposed within head 50 at an end of piston 80 opposite to the work tool 25 and may be configured to contain a compressible gas, for example nitrogen. The chamber 100 works as an accumulator. Piston 80 may be slidably moveable within chamber 100 to increase and decrease the size of chamber 100. A decrease in size of chamber 100 may increase the gas pressure within chamber 100. A pressure release valve (not shown) may be provided on the head 50. The pressure inside the chamber 100 may be released by actuating the pressure release valve before disassembling the hammer 20. In some embodiments, a diaphragm is placed in the chamber 100 to separate the chamber 100 in two compartments. In such embodiments, the passage 200 may be provided connected to the portion of chamber 100 that is configured to hold pressurized gas.

A passage 200 is defined in the wall 52 of head 50. The passage 200 works as a gas discharge passage. The passage 200 has a first end 202 fluidly connected to the chamber 100, and a second end 204 on the head flange 54 of the head 50. The passage 200 is suitably sized to permit gas in the chamber 100 to escape through the passage 200. The second end 204 of the passage 200 may define a receptacle 210 for receiving a plug 300. The receptacle 210 may be defined in the wall 52 of the head 50. In other embodiments, the receptacle 210 may be a structure inserted in the passage 200 and configured to selectively retain the plug 300.

Figure 4:
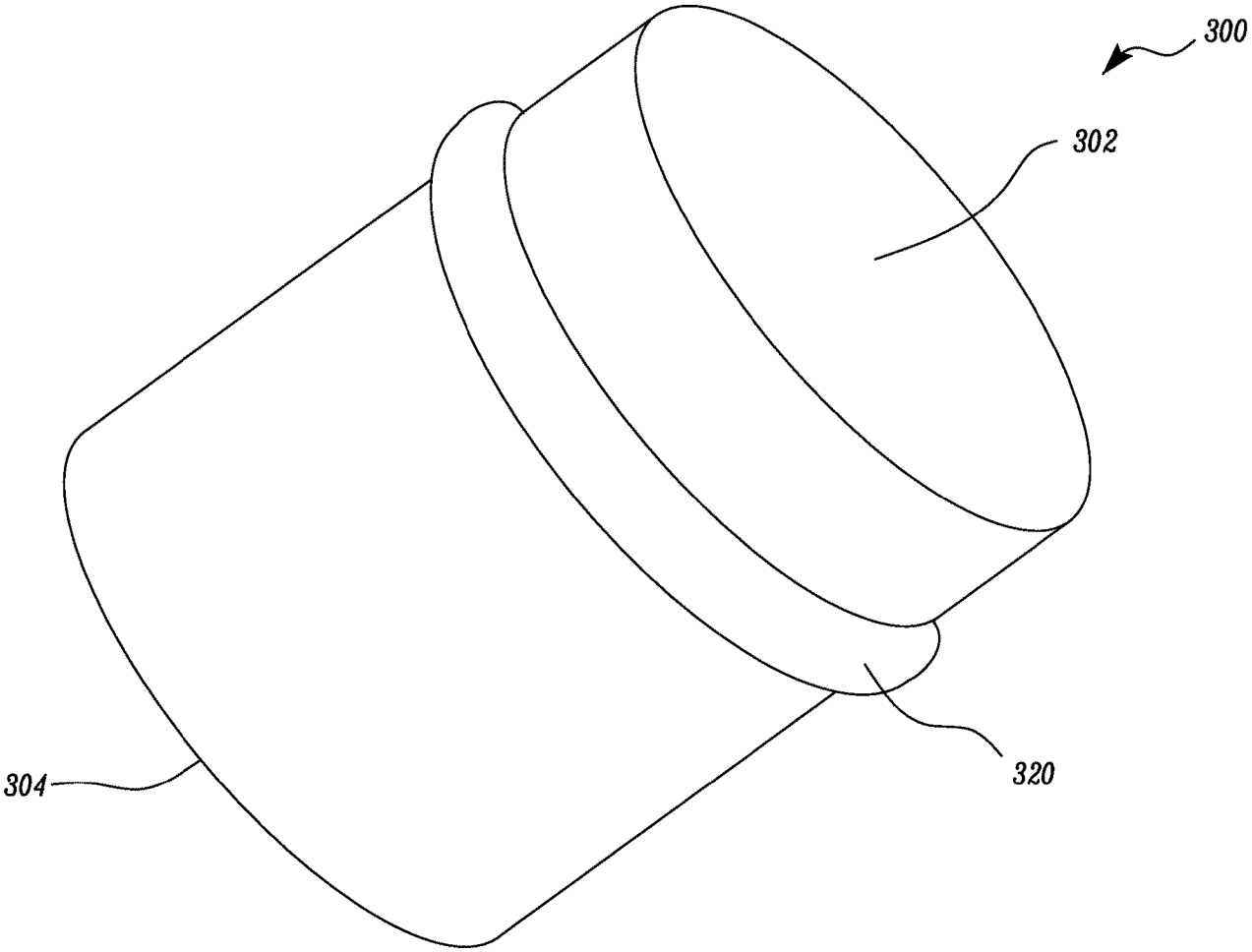
FIG. 4 illustrates a plug in accordance with an embodiment.

FIG. 4 illustrates the plug 300 in accordance with an embodiment. The plug 300 seals the second end 204 of the passage 200. The plug 300 is not configured to withstand the gas pressure in the chamber 100 during normal operation of the hammer 20 and will accordingly be fully or partly pushed out of the passage 200 on separation of the housing 40 from the head 50. In other embodiments, the plug 300 is not configured to withstand the gas pressure in the chamber 100 during normal operation of the hammer 20 and will deform to allow release of pressurized gas through the passage 200 when the housing 40 is separated from the head 50. In alternate embodiments, the plug 300 may be configured to withstand a threshold gas pressure before being pushed out of the passage 200. In an assembled state of the hammer 20, an end face 302 of the plug 300 abuts the housing flange 42 of the housing 40 and thus is prevented from coming out of the passage 200.

The plug 300 may be configured to be press fitted into the receptacle 210 to close the passage 200. In other embodiments, the plug 300 may have a seal 320 that engages an inner surface 230 of the receptacle 210. The seal 320 may fill the clearance between the plug 300 and the inner surface 230 of the receptacle 210. The seal may be a deformable seal. The plug 300 may be of any suitable material, for example rubber, FEP, silicone, etc.

On loosening of the fasteners 60, the housing flange 42 of the housing 40 may get gradually separated from the head flange 54 of the head 50. The gap in between the head flange 54 and the housing flange 42 may permit the plug 300 to partially come out of the receptacle 210 or deform due to the pressure of the gas in the chamber 100 acting on the plug 300. The movement or deformation of the plug 300 may open the passage 200 and allow the pressurized gas in the chamber 100 to escape. Thus, the pressure inside the chamber 100 may be relieved automatically as the fasteners 60 are loosened. Additionally, the sound of the gas leaking via passage 200 on loosening the fasteners 60 may also alert the service personnel about presence of pressurized gas in the head 50. In alternate embodiments, the receptacle 210 or the plug 300 may be provided with a sound indication device, for example a whistle, that may actuated by the pressurized gas escaping from the passage 200 for alerting service personnel.

During assembly of the hammer 20, along with placing other components in the housing 40, the plug 300 may be inserted in the receptacle 210 in the passage 200 defined by the wall 52 of the head 50, before the head 50 is assembled to over the housing 40. The head 50 may be fastened over the housing 40, with the plug 300 placed inside the passage 200. The chamber 100 may be pressurized after the head 50 is assembled over the housing 40.

In an alternate embodiment, the hammer may include a first member and a second member configured for attachment to each other. In the embodiment illustrated in FIG. 2, the first member may be the head 50 and the second member may be the housing 40. The first member and the second member may define a chamber 100 for holding a pressurized gas. In the embodiment illustrated, the chamber 100 holds a pressurized gas. Further, a gas discharge passage, for example passage 200, may be defined in the first member. The gas discharge passage may extend between the chamber 100 and an outside surface of the first member. The outside surface may be the flange 54 of the head 50 as illustrated. Further, a plug 300 may be inserted in the gas discharge passage. The plug may be retained in the gas discharge passage against the pressure of the gas in the chamber 100 by the second member. The plug 300 permits escape of gas through the gas discharge passage when the first member is separated from the second member.

In an embodiment, the plug 300 placed in the gas discharge passage may abut the second member. In another embodiment, the plug 300 may define a clearance with the gas discharge passage. In an embodiment, the first member may be attached to the second member using bolts. In an embodiment, nitrogen may be used to pressurize the chamber 100.

INDUSTRIAL APPLICABILITY

Figure 5:
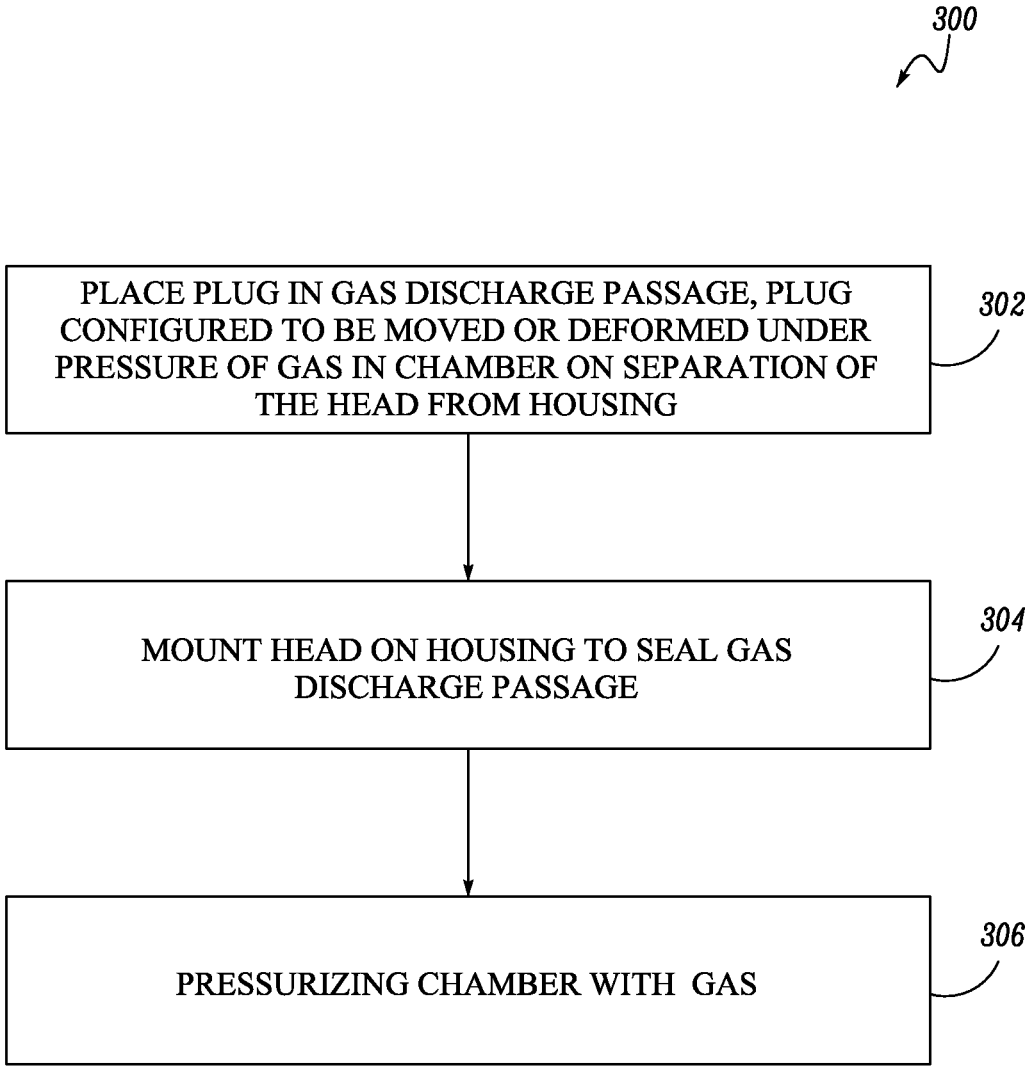
FIG. 5 illustrates a method of assembling a hammer in accordance with an embodiment.

The present disclosure provides for a method 500 of assembling a hammer 20. The hammer 20 includes a housing 40 for holding a piston 80 and a head 50 is mounted over the housing 40. The head 50 defines a chamber 100 for holding a pressurized gas. Wall 52 of the head 50 is configured to abut the housing 40 and defines a passage 200 extending between the chamber 100 and the housing 40. The method 500 of assembling such hammer 20 includes following steps. Referring to FIG. 5, step 502 includes placing a plug 300 in the passage 200 to prevent escape of gas from the chamber 100 such that the plug 300 is configured to be ejected from the head 50 cap under pressure of the gas in the chamber 100. Step 504 includes mounting the head 50 on the housing 40 such that the ejection of the plug 300 from the head 50 is prevented by the housing 40. Step 506 includes pressurizing the chamber 100 with a gas.

In an embodiment, the method 500 may further include mounting the head 50 over the housing 40 using bolts. In another embodiment, method 500 may further include providing a seal 320 between the plug 300 and the wall 52 of the head 50 to seal the passage 200. In an embodiment, the method 500 may further include pressurizing the chamber 100 with nitrogen. In another embodiment, the method 500 in step 502 may include providing a sound indication device in the passage 200. In an embodiment, the method 500 may include mounting the head 50 over the housing 40 with the plug 300 inserted in the passage 200 such that the plug 300 abuts the housing 40.

The hammer assembly in accordance with the present disclosure may provide for a discharge passage 200 for pressurized gas present in an accumulator used in the hammer 20. The passage 200 in accordance with the present disclosure obviates need of a valve or any other tools for releasing pressure inside the chamber 100.

If the hammer 20 is disassembled without releasing the pressure inside the chamber 100, the pressurized gas may create an audible noise or hissing sound while escaping. Further, a sound indication device may be placed inside the passage 200. The sound produced by the sound indication device may provide for a warning signal for alerting the service personnel about presence of high pressure in the chamber 100. The service personnel may take appropriate action on hearing such sound alarm. This way any untoward accidents while servicing the hammer 20 may be avoided.

In an embodiment, the passage and the plug may be retrofitted in existing hammers. A passage 200 may be created in the wall 52 of the head 50 using known methods and tools in the art. Such passage 200 may provide for an escape passage for the pressurized gas in the chamber 100. The passage 200 may be fitted with a plug 300. It is understood that the shape and size of the passage 200 and the plug 300 may be chosen as suited for the design of the hammer 10.

The hammer assembly including the passage 200 for accumulators of the present disclosure may provide for a low cost solution for releasing pressure in the chamber 100 of the accumulator. The cost of maintenance of the arrangement as disclosed may be merely cost of replacing the plug 300. In an embodiment, reusable plugs may be used.

What is claimed is:

1. A hydraulic hammer comprising:

an elongated housing;

a removable head assembled on an end of the elongated housing and defining a chamber for holding a pressurized gas, the head including a wall extending transverse thereto and configured to abut the housing and defining a gas discharge passage extending between the chamber and the housing;

a fastener configured to removably attach the head to the housing;

a piston arranged for reciprocating movement within the head and the housing; and an elastomeric plug positioned in the gas discharge passage and configured to move or deform under pressure of the pressurized gas in the chamber upon loosening of the fastener and removal or separation of the head from the housing.

2. The hammer of claim 1, wherein the plug abuts the housing.

3. The hammer of claim 1, wherein the plug defines a clearance with the gas discharge passage.

4. The hammer of claim 3, wherein the plug comprises of a seal configured to engage the gas discharge passage.

5. The hammer of claim 1, wherein the fastener is at least one bolt.

6. The hammer of claim 1, wherein the pressurized gas is nitrogen.

7. The hammer of claim 1, wherein the gas discharge passage has a first end exposed to the chamber and a second end having a receptacle configured to receive the plug.

8. A hydraulic hammer, comprising:

a first member and a second member configured for attachment to each other and defining a chamber for holding a pressurized gas, the first member including a head and wall extending transverse thereto;

a fastener configured to removably attach the first member to the second member;

a piston arranged for reciprocating movement within the first member and the second member;

a gas discharge passage defined in the first member wall and extending between the chamber and an outside surface of the first member; and an elastomeric plug inserted in the gas discharge passage, the plug retained in the gas discharge passage against the pressure of the gas in the chamber by the second member such that the plug permits escape of the gas through the gas discharge passage upon loosening of the fastener and removal or separation of the first member from the second member without the use of a valve.

9. The hammer of claim 8, wherein the plug abuts the second member.

10. The hammer of claim 8, wherein the plug defines a clearance with the gas discharge passage.

11. The hammer of claim 8, wherein the plug comprises of a deformable seal.

12. The hammer of claim 8, wherein the fastener is at least one bolt.

13. The hammer of claim 8, wherein the pressurized gas is nitrogen.

14. The hammer of claim 8, further comprising a sound indication device placed in the passage.

* * * * *